US006116056A

United States Patent [19]

Joyce

[11] Patent Number: 6,116,056

[45] Date of Patent: Sep. 12, 2000

[54] METHOD OF KNITTING AN IMPROVED COMFORT SELVAGE

[75] Inventor: Donald D. Joyce, Blue Springs, Mo.

[73] Assignee: Royal Knit, Inc., Lee's Summit, Mo.

[21] Appl. No.: 09/258,868

[22] Filed: Feb. 26, 1999

Related U.S. Application Data

[60] Provisional application No. 60/076,366, Feb. 27, 1998.

[51] Int. Cl.[7] ..... D04B 7/04

[52] U.S. Cl. ..... 66/64; 66/75.1

[58] Field of Search ..... 66/169 R, 170, 66/172 R, 171, 178 R, 179, 64, 75.1

[56] References Cited

U.S. PATENT DOCUMENTS 5,271,249 12/1993 Mitsumoto et al. ..... 66/60 R 5,456,096 10/1995 Mitsumoto et al. ..... 66/69

5,537,843 7/1996 Okuno ..... 66/64

5,887,451 3/1999 Suzuki ..... 66/64

*Primary Examiner*—Danny Worrell

*Attorney, Agent, or Firm*—Chase & Yakimo, L.C.

[57] ABSTRACT

A method of knitting an improved comfort selvage on a V-bed flat knitting machine by manipulating the front and rear needles independently at the selvages. By using an asymmetrical knitting pattern at the selvage, a knitted double-lock selvage is produced that has no ridge on one side of the fabric or holes, thus improving the wearing comfort and aesthetic appeal of the garment.

9 Claims, 2 Drawing Sheets

METHOD OF KNITTING AN IMPROVED COMFORT SELVAGE

CROSS REFERENCE TO RELATED APPLICATION

This application claims the benefit of the prior filed, pending provisional application, Ser. No. 60/076,366, filed Feb. 27, 1998.

BACKGROUND OF THE INVENTION

The present invention relates to a method of knitting the selvage of a tubular knit fabric, and more particularly, a method of knitting the selvage on a double lock V-bed flat knitting machine without producing a raised seam.

Tubular or weft knit is produced on a V-bed flat knitting machine by knitting, row by row, a front sheet of fabric and a rear sheet of fabric and binding together the edges, or selvages to form a knitted fabric tube.

In knitting the selvage of a double lock tubular knit fabric with a flat knitting machine, it is known to knit the front needles when the yarn carrier is moving from right to left, and to knit the rear needles when the yarn carrier is moving from left to right. The conventional method of knitting the selvages leaves a raised seam on both the inside and the outside of the tube which makes the garment, especially close fitting garments such as socks, particularly prosthetic socks, uncomfortable to wear. Additionally, the conventional method of knitting the selvages leaves holes along the selvages further reducing the wearing comfort and the aesthetic appeal of the garment.

In another known method, the selvages are simply sewn together to form the tube. This creates a raised seam on the inside of the tube.

SUMMARY OF THE INVENTION

Accordingly, it is the primary object of the present invention to produce a knitted double lock selvage that does not have a ridge on one side of the fabric.

Additionally, it is another object of this invention to produce a knitted double lock selvage that has no holes.

These objects are achieved by the selective activation of the front and rear needles on each pass of the yarn carrier of the double lock machine. Such activation occurs at each selvage to produce a seam that has no ridge on the inside of the tubular garment, by controlling the idle and knitting states of each needle.

DETAILED DESCRIPTION

Figure 1:
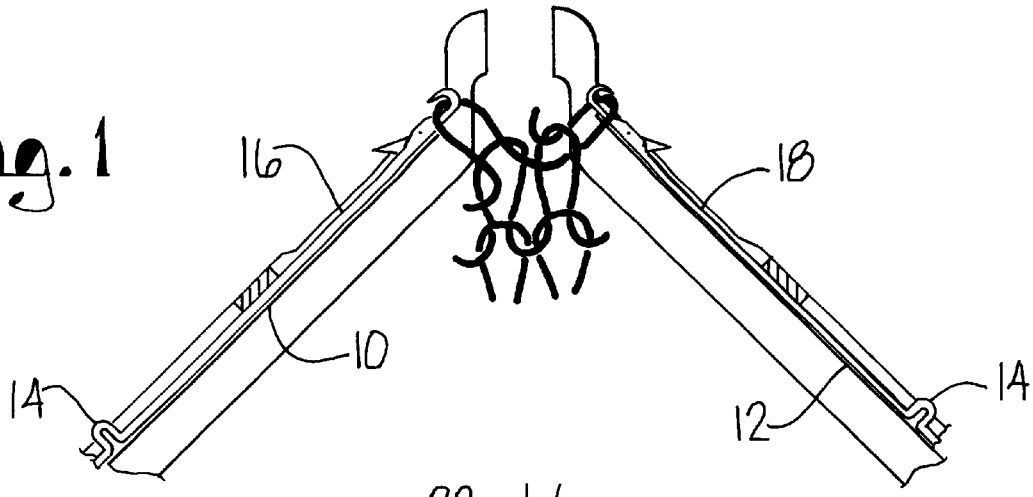
FIG. 1 is a cross sectional view of a V-bed flat machine showing front and rear needlebeds and needles in the idle position.
Figure 2:
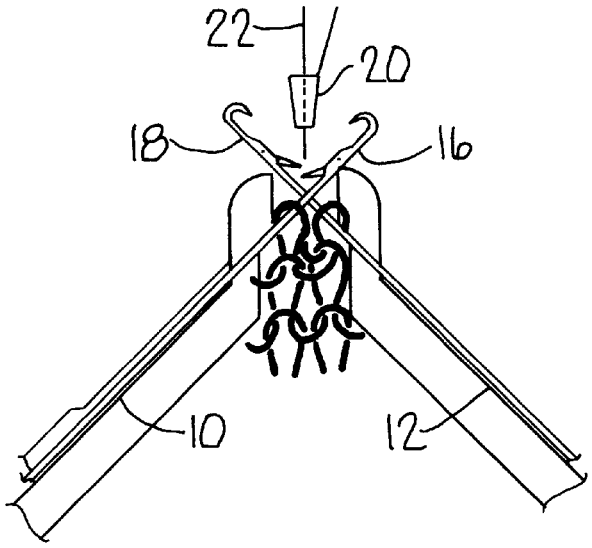
FIG. 2 is a cross sectional view of a V-bed flat machine showing needles in the knitting position.
Figure 3:
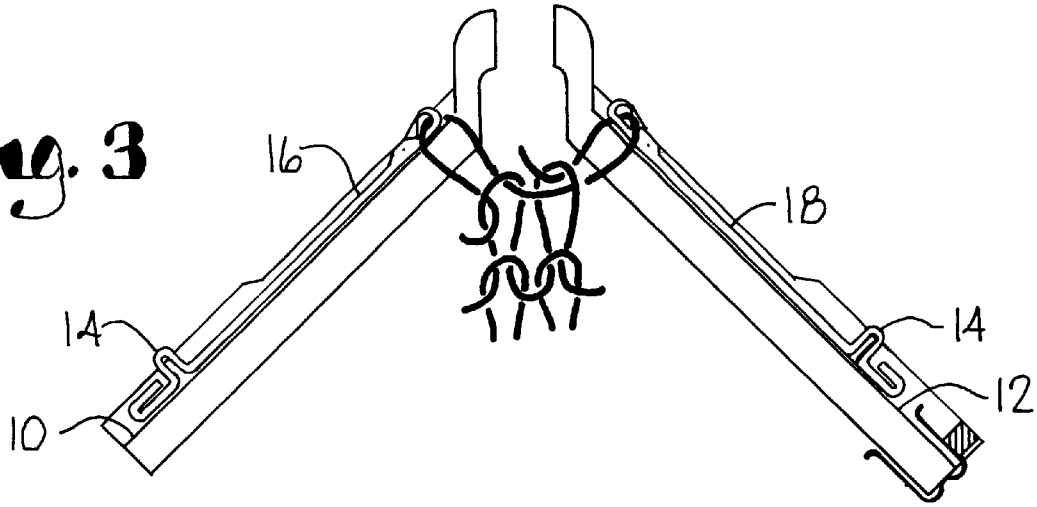
FIG. 3 is a cross sectional view of a V-bed flat machine showing needles in the cast-off position.
Figure 4:
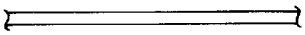
FIG. 4 is a schematic view of first lock pass of right selvage showing front and rear needles idle, yarn carrier moving from left to right.
Figure 10:
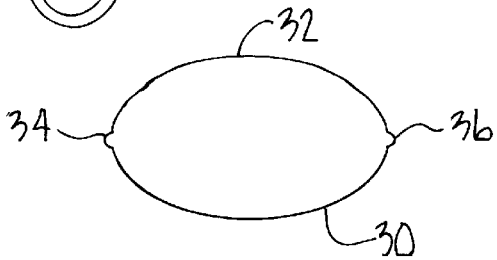
FIG. 10 is a diagrammatic cross-sectional illustration of a completed tubular garment made in accordance with the method of the present invention.

A conventional V-bed flat machine, illustrated in FIGS. 1 and 2, is a latch needle machine in which front and rear opposed needlebeds 10 and 12 respectively, are arranged in an inverted "V" in the form of a 90 degree angle to each other and at a 45 degree angle to the horizontal. In addition to the front and rear opposed needlebeds 10 and 12, the machine's major components include its cams (not shown) which act on either the butts 14 of front and rear latch needles 16 and 18 respectively, or the butts of associated jacks, which in turn actuate the latch needles and a yarn carrier 20. On a double lock machine, the yarn carrier 20 includes two side-by-side locks, which feed the yarn 22 to the needles 16 and 18. As the yarn carrier 20 passes the needles as it travels back and forth, the needles are either idle or knitting. When idle, the yarn carrier passes without any needle action. When a needle is knitting, as the yarn carrier passes, the needle is activated by its associated cam, the needle receives the yarn, and casts off the previous stitch (FIG. 3). To form a tubular double lock garment (illustrated diagrammatically in FIG. 10), the yarn carrier moves back and forth along the needle beds transferring yarn to the needles in a set knitting pattern.

The needle activation for the conventional method of knitting the selvages is set forth in Table 1 below.

TABLE 1

Prior Art

| Yarn carrier Direction | Lock | Needles | Left Selvage | Right Selvage |
|---|---|---|---|---|
| Left to Right | First | Front | Idle | Idle |
| | | Rear | Knit | Knit |
| | Second | Front | Idle | Idle |
| | | Rear | Knit | Knit |
| Right to Left | First | Front | Knit | Knit |
| | | Rear | Idle | Idle |
| | Second | Front | Knit | Knit |
| | | Rear | Idle | Idle |

As the yarn carrier moves from left to right, the first lock encounters the left selvage of the knitted garment. As the first lock then passes the left selvage, the front needle is idle and the rear needle knits. As the second lock passes the left selvage, the front is idle and the rear needle knits. As the first lock passes the right selvage, the front is idle and the rear needle knits. As the second lock passes the right selvage, the front needle is idle and the rear needle knits.

The yarn carrier then reverses direction and moves from right to left. As the carrier moves from right to left, the order of the locks is reversed. The first lock when moving from left to right is the second lock when moving from right to left. Likewise, the second lock when moving from left to right is the first lock when moving from right to left.

As the first lock encounters the right selvage, the front needle knits and the rear needle is idle. As the second lock passes the right selvage, the front needle knits and the rear needle is idle. As the first lock encounters the left selvage, the front needle knits and the rear needle is idle. As the second lock passes the left selvage, the front needle knits and the rear needle is idle. This process is repeated along the entire length of the garment.

Figure 9:
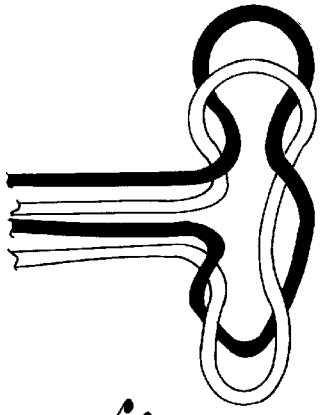
Fig. 9 PRIOR ART
FIG. 9 is prior art showing a conventional right selvage knit pattern.

A cross section of one cycle of the conventional selvage knit pattern for the right selvage is shown FIG. 9. The left selvage pattern is a mirror image of the right selvage pattern and therefore is not shown.

In the present invention, the needles are activated in accordance with Table 2 below.

TABLE 2

| Present Invention | | | | |
|---|---|---|---|---|
| Yarn carrier Direction | Lock | Needles | Left Selvage | Right Selvage |
| Left to Right | First | Front | Idle | Idle |
| | | Rear | Knit | Idle |
| | Second | Front | Knit | Idle |
| | | Rear | Knit | Knit |
| Right to Left | First | Front | Idle | Knit |
| | | Rear | Idle | Idle |
| | Second | Front | Idle | Knit |
| | | Rear | Knit | Knit |

Figure 5:
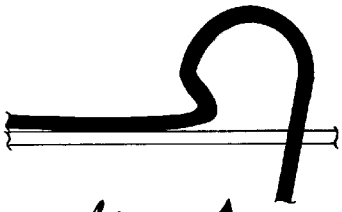
FIG. 5 is a schematic view of second lock pass of right selvage showing front needle idle and rear needle knitting, yarn carrier moving from left to right.
Figure 6:
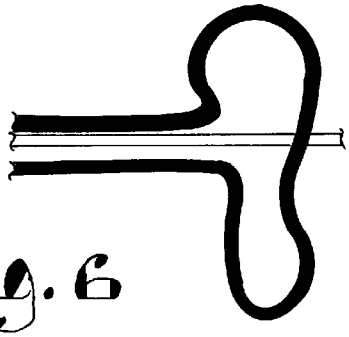
FIG. 6 is a schematic view of first lock pass of right selvage showing front needle knitting and rear needle idle, yarn carrier moving from right to left.

As the yarn carrier moves from left to right, the first lock encounters the left selvage of the knitted garment. As the first lock then passes the left selvage, the front needle is idle and the rear needle knits. As the second lock passes the left selvage, both the front and rear needles are idle. As the first lock passes the right selvage, both the front and rear needles are idle (FIG. 5). As the second lock passes the right selvage, the front needle is idle and the rear needle knits (FIG. 6).

Figure 8:
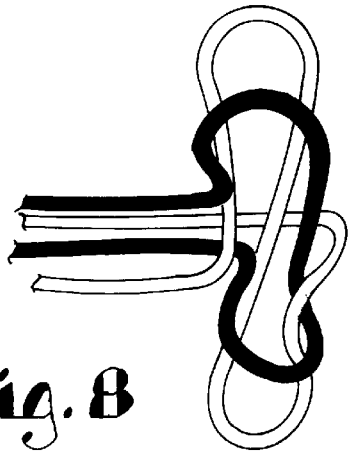
FIG. 8 is a schematic view of second lock pass of right selvage showing rear needle knitting, yarn carrier moving from right to left. Completed right selvage knit pattern is shown.
Figure 7:
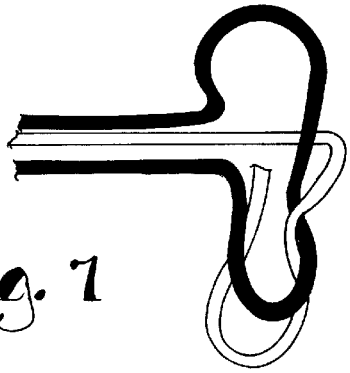
FIG. 7 is a schematic view of second lock pass of right selvage showing front needle knitting, yarn carrier moving from right to left.

The yarn carrier then reverses direction and moves from right to left. Again, the order of the locks is reversed as described above. As the first lock encounters the right selvage, the front needle knits and the rear needle is idle (FIG. 7). As the second lock passes the right selvage, both the front and rear needles knit (FIG. 8). As the first lock encounters the left selvage, both the front and rear needles are idle. As the second lock passes the left selvage, the front needle knits and the rear needle is idle. This process is repeated along the entire length of the garment. The knit pattern of the left selvage is an inverted mirror image of the right selvage and therefore is not shown.

Using the method of the present invention, a double lock tubular knit fabric is formed (FIG. 10) in which a front sheet of fabric 30 and a rear sheet of fabric 32 are bound together at the left selvage 34 and the right selvage 36. Selvages 34 and 36 formed as described above, each provide a seam that is smooth on the inside and raised on the outside of the tube without holes, thus improving the wearing comfort and aesthetic appeal of the garment.

Having thus described the invention, what is claimed as new and desired to be secured by letters patent is as follows:

1. A method of knitting a first selvage and a second selvage of a garment comprising:

providing a flat bed knitting machine having a front needle bed, a rear needle bed, and a slideably mounted yarn carrier, said needle beds having independently operable needles, said front needle bed having a first selvage needle and a second selvage needle, said rear needle bed having a first selvage needle and a second selvage needle, said yarn carrier having a first lock and a second lock for transferring yarn to said needles, forming said first selvage by moving said first lock from a first position to a second position and knitting on said rear bed first selvage needle, moving said second lock from a first position to a second position, knitting on said front bed first selvage needle and knitting on said rear bed first selvage needle, moving said second lock from said second position to said first position, and moving said first lock from said second position to said first position and knitting on said rear bed first selvage needle, forming said second selvage by moving said first lock from said first position to said second position, moving said second lock from said first position to said second position and knitting on said rear bed second selvage needle, moving said second lock from said second position to said first position and knitting on said front bed second selvage needle, moving said first lock from said second position to said first position and knitting on said rear bed second selvage needle and knitting on said front bed second selvage needle.

2. A method of knitting a first selvage and a second selvage of a garment comprising:

providing a flat bed knitting machine having a front needle bed, a rear needle bed, and a slideably mounted yarn carrier, said needle beds having independently operable needles, said front needle bed having a first selvage needle and a second selvage needle, said rear needle bed having a first selvage needle and a second selvage needle, said yarn carrier having a first lock and a second lock for transferring yarn to said needles, forming said first selvage and said second selvage by moving said first lock from a first position to a second position and knitting on said rear bed first selvage needle and knitting on said front needle bed needles, moving said second lock from a first position to a second position, knitting on said front bed first selvage needle, knitting on said rear bed first selvage needle, knitting on said front needle bed needles, and knitting on said rear bed second selvage needle, moving said second lock from said second position to said first position on said front bed second selvage needle, and knitting on said rear needle bed needles, moving said first lock from said second position to said first position, knitting on said rear bed second selvage needle, knitting on said front bed second selvage needle, knitting on said rear needle bed needles, and knitting on said rear bed first selvage needle.

3. A method of knitting a selvage of a garment comprising:

providing a flat bed knitting machine having a front needle bed, a rear needle bed, and a slideably mounted yarn carrier, said needle beds having independently operable needles, said front needle bed having a selvage needle, said rear needle bed having a selvage needle, said yarn carrier having a first lock and a second lock for transferring yarn to said needles, forming said selvage by moving said first lock from a first position to a second position, knitting on said rear bed selvage needle, and knitting on said front bed needles, moving said second lock from a first position to a second position, knitting on said front bed selvage needle, knitting on said rear bed selvage needle, and knitting on said front bed needles, moving said second lock from said second position to said first position, and knitting on said rear bed needles, and moving said first lock from said second position to said first position, knitting on said rear bed selvage needle, and knitting on said rear bed needles.

4. The method of claim 1, wherein said steps of forming said first and second selvages are repeated.

5. The method of claim 2, wherein said steps of forming said first and second selvages are repeated.

6. The method of claim 3, further comprising forming a second selvage by moving said first lock from said first position to said second position, and knitting on said front bed needles, moving said second lock from said first position to said second position, knitting on said front bed needles, and knitting on a second rear selvage needle, moving said second lock from said second position to said first position, knitting on a second front selvage needle and knitting on said rear bed needles, moving said first lock from said second position to said first position, knitting on said second rear selvage needle, knitting on said second front selvage needle, and knitting on said rear bed needles.

7. The method of claim 3, wherein said step of forming said selvage is repeated.

8. The claim of claim 6, wherein said step of forming said second selvage is repeated.

9. A method of knitting a selvage of a garment comprising:

providing a flat bed knitting machine having a front needle bed, a rear needle bed, and a slideably mounted yarn carrier, said needle beds having independently operable needles, said front needle bed having a selvage needle, said rear needle bed having a selvage needle, said yarn carrier having a first lock and a second lock for transferring yarn to said needles, said locks moveable between a first position and a second position, providing an idle operation wherein at least one of said selvage needles is idle when said locks are moved between said first and said second positions, providing a knit operation wherein at least one of said selvage needles is knitting when said locks are moved between said first and said second positions, forming a selvage by repeating a sequence comprising said idle operation, followed by a plurality of said knit operations, followed by a plurality of said idle operations, followed by said knit operation.

* * * * *